US006439547B1

(12) United States Patent
King et al.

(10) Patent No.: US 6,439,547 B1
(45) Date of Patent: Aug. 27, 2002

(54) CARBURETOR THROTTLE AND CHOKE CONTROL MECHANISM

(75) Inventors: Eric L. King; George M. Pattullo, both of Caro, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/799,187

(22) Filed: Mar. 5, 2001

(51) Int. Cl.[7] ..... F02M 1/02
(52) U.S. Cl. ..... 261/52; 123/179.18; 261/64.6
(58) Field of Search ..... 261/52, 64.6; 123/179.18, 123/185.14, 185.1, 339.25

(56) References Cited

U.S. PATENT DOCUMENTS

| | | | | |
|---|---|---|---|---|
| 2,160,411 A | | 5/1939 | Blattner et al. | 261/52 |
| 3,807,709 A | * | 4/1974 | Suda et al. | 261/52 X |
| 3,862,278 A | * | 1/1975 | Nakada et al. | 261/52 |
| 3,907,945 A | * | 9/1975 | Kobayashi et al. | 261/52 |
| 4,123,480 A | | 10/1978 | Johansson | 261/52 |
| 4,167,929 A | | 9/1979 | Dubois | 74/534 X |
| 4,176,648 A | | 12/1979 | Gotoh et al. | 185/40 R X |
| 4,230,084 A | | 10/1980 | Gotoh et al. | 123/185.14 |
| 4,368,704 A | | 1/1983 | Masaki | 123/588 X |
| 4,439,377 A | * | 3/1984 | Nartowski | 261/64.6 X |
| 5,069,180 A | | 12/1991 | Schmidt et al. | 123/376 |
| 5,200,118 A | | 4/1993 | Hemle | 261/64.6 |
| 5,500,159 A | | 3/1996 | Martinsson | 261/52 |
| 5,611,312 A | | 3/1997 | Swanson et al. | 123/436 |
| 5,891,369 A | * | 4/1999 | Tuggle et al. | 261/52 X |
| 6,000,683 A | | 12/1999 | Van Allen | 261/52 |
| 6,202,989 B1 | * | 3/2001 | Pattullo | 123/179.18 X |
| 2001/0013664 A1 | * | 8/2001 | Kobayashi | 261/52 |

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A carburetor throttle and choke control mechanism incorporating a choke-throttle cold-start fast idle setting latch mechanism having, in a first embodiment, a blade of a fast idle lever specially contoured for creating upon interengagement with a tang on a throttle lever initial torque resistance to co-rotation of the fast idle lever toward latched condition and then effecting force reversal for creating aiding torque to accelerate the fast idle lever relative to choke lever and thereby open a gap in the push coupling that remains in the latched position of the choke and throttle valves. The choke lever has a relatively rigid pusher leg portion adapted for abutment in push relation with a fast idle lever tang. In a second embodiment an extension of the leg portion in the form of a generally U-shaped resilient spring hook portion is adapted to overlap the tang and releasably hook engage the same when the leg portion is brought into full push abutment with said tang. The U-shaped hook portion is resiliently flexible to act as a spring to develop a torque on the choke by pulling the choke valve fully closed when said fast idle lever is moved to fully latched condition while flexing so that the gap remains between the pusher leg portion and the tang.

21 Claims, 6 Drawing Sheets

CARBURETOR THROTTLE AND CHOKE CONTROL MECHANISM

FIELD OF INVENTION

The present invention relates to throttle and choke control mechanisms of carburetors for internal combustion engines, and more particularly to such a mechanism incorporating a choke-throttle, cold-start-setting latch mechanism that automatically positions the throttle valve slightly open when the choke valve is fully closed.

BACKGROUND OF THE INVENTION

In small carburetors designed for use with low displacement gasoline fueled engines, such as used on chain saws, weed whips, lawn mowers, garden tractors and other small lawn, garden, and forestry portable appliances, manually operated choke and throttle controls are typical provided and often hand cranking is employed for starting the engine. Prior to the late 1970s, chain saws equipped with such choke and throttle controls often involved a basic starting sequence which left much to be desired. First the choke valve was fully closed to its start position, and then the starter rope was pulled until the engine fired. The closed choke valve usually caused the engine to immediately die at this first firing due to over-enrichment of the air/fuel (A/F) mixture. This is commonly referred to as a false start. At this point the choke valve had to be opened. Then the starter rope was pulled again until the engine finally began running.

This starting sequence was subsequently improved by adding another start-up control to the chain saw whereby the throttle valve could be held at a partly opened position, known as fast idle position. This generally avoided false starts due to the increased air flow permitted past the throttle valve.

In order to avoid the need for three separate manually operated controls, namely, a throttle control, a choke control and fast idle start control Johansson, U.S. Pat. No. 4,123,480, issued Oct. 31, 1978 (which is incorporated herein by reference), disclosed an improved chain saw engine control mechanism. In the '480 patent a fast idle secondary lever 9 is pivoted on the choke valve shaft 11 and is operable to engage a latch arm of a throttle lever 4 fixed on the throttle valve shaft 2 to cause the throttle valve 1 to open to a predetermined angle corresponding to the fast idle position (FIG. 3). With this arrangement, the operator need only operate a single start-up control, namely the choke valve control (not shown) coupled to the choke shaft control lever 12 in order to set the throttle 1 in fast idle condition. Thus, when the operator moves the choke control to swing the choke valve 10 from fully open position (FIG. 1) to its fully closed start position (FIG. 3), the pivotal motion of choke shaft control lever 12, via a push coupling tang 14 on the adjacent fast idle lever 9, pivots fast idle lever 9 and causes its notch 8 to latch engage the throttle lever latch arm tang 7, thereby automatically setting the fast idle latch mechanism. The normal biasing forces exerted by the respective fast idle lever spring and throttle shaft return spring (i.e., biasing the fast idle lever toward push coupling with the choke lever: biasing throttle valve 34 toward closed) and also used to provide the latch closing forces.

Then, due to this automatic latch up, if the chain saw engine experiences a false start, the choke lever 12 may be moved to the open position (FIG. 4) without thereby moving the fast idle lever i.e., because it remains engaged with the throttle lever to retain the throttle valve 1 in the fast idle position. Once the chain saw engine starts, the operator simply depresses the throttle control trigger 6 to open the throttle valve 1. This pivots the throttle shaft lever 4, thereby causing it to disengage the fast idle lever 9 and thus cause release of the latch. If the choke valve 10 was still in the closed position at this point, the choke biasing spring 15, acting through the fast idle lever 9 and tang 14 coupling it to the choke lever, would automatically cause the choke valve 10 to be returned to full open position upon such unlatching of the fast idle lever 9 from the throttle lever 4 (FIG. 1).

One of the disadvantages of this fast idle starting system (FISS) '480 patent design was its failure in practice when mass produced to insure complete and/or consistent closure of the choke valve 10 when setting the fast idle latch starting system. The specific problem has been found to be due to a pull-back or rock-back effect by the fast idle lever exerted on the choke lever resulting in the choke valve sometimes not being completely closed even though the operator has fully engaged the choke control to indicated start position. Further, it has been found that this problem is due to the need to provide an "over-travel" gap in the resting engagement of throttle lever tang in the fast idle lever notch to accommodate a stack up of normal manufacturing tolerances in the parts as manufactured for assembly into the fast idle latch mechanism.

Such manufacturing tolerances are, of course, necessary to set up minimum dimensional range limits or allowances to accommodate normal manufacturing equipment capabilities at acceptable manufacturing cost levels. This is a particular problem in producing carburetors for engines for chain saws, lawn mowers, clearing saws, weed whips, etc. that require very low manufacturing cost due to the low retail price of such consumer products. The problem is compounded due to the small size of the carburetors for such small engines, and the corresponding minuscule size of the choke and throttle parts involved in the carburetor mechanisms. These factors make it particularly difficult to reduce manufacturing tolerance allowances in order to reduce the adverse effects of unavoidable manufacturing dimensional variations in such tiny parts when assembled for operation in the mechanism.

Thus, in the case of the incomplete and/or inconsistent closure of the choke valve in the operation of the fast idle starting system of the '480 patent arrangement, it has been found that, without the aforementioned over-travel gap allowance, a shift in tolerances for all parts (tolerance stack-up) in the latch mechanism to one end limit will render the choke valve incapable of reaching the fully closed position. This prevents, or at least hinders engine starting. On the other hand, and without such gap allowance, a tolerance shift in all of these parts to the opposite end limit will cause the fast idle lever to fail to even engage with the throttle lever, so that no "latch up" action occurs. This results in a loss of function of the entire choke throttle fast idle system.

The culprit in this resultant choke valve pull-back or rock-back problem has been found to be the push coupling of choke lever 12 with the fast idle lever 9 (via tang 14). This dictates that the actual latch-set position of choke valve 10 when initially swung to fully closed position will be controlled by the final latched-up position of fast idle lever 9. The over-travel gap in the engaged tang and notch parts allows the fast idle lever and throttle lever (if indeed engaged) both to be swung slightly back by their biasing springs until latched into their spring held, stable, latched position after manipulating forces are removed from the manual controls of the appliance. This problem of the adverse "spring-back" or "pull-back" effect on the fast idle start settings of the choke and throttle valves when latched will be further explained and seen in more detail hereinafter. Another prior art solution to the problem of achieving automatic fast idle setting of the throttle valve is found in Hermle U.S. Pat. No. 5,200,118, issued Apr. 6, 1993 and assigned to Walbro Corporation of Cass City, Mich., assignee of record herein. (U.S. Pat. No. 5,200,118 also being incorporated herein by reference). The '480 patent is also described in the '118 patent. It will be seen from FIGS. 1–5 of the '118 patent, and by reference to the specification and claims of the '118 patent, that the choke valve 10 is "divorced" as to its operator control handle 16 and associated linkage from the control handle 28 and associated linkage for the fast idle lever 20, which is thus independently operated through its own crank arm 24 of its bell crank 20. The '118 system thus avoids the "spring-back" problem by adding a separate manual control 16 to operate the choke valve 10, and likewise the fast idle latch lever 20 is operated solely by actuating its own control member 28. It will be seen that with the '118 patent system there is no tang coupling between choke lever arm 12 and the fast idle latch bell crank 20. Hence the '118 patent system, although more complex in structure and mode of operation, does not present the aforementioned incomplete choke closure problem of the '480 patent system.

Thus, the aforementioned prior art '118 and '480 patents neither address the problems nor provide a solution thereto that insures that, in the case of the '480 type fast idle start mechanism, as manufactured in mass production practice, the choke will be able to reach the fully closed position at fast idle latch-up. Therefore, the problems of poor starting, or in worst case, "no starting", continued to prevail for many years despite the wide spread use of the'480 system on carburetors supplied by several major carburetor manufacturers utilizing the '480 system.

One recently commercially adopted solution to the foregoing problems is that set forth in Van Allen U.S. Pat. No. 6,000,683 issued Dec. 14, 1999 and also assigned to Walbro Corporation, which is incorporated in toto herein by reference. This '683 patent invention works well when the choke valve completely closes and the fast idle lever has no play in the nested (locked-up) position. In this invention the small advancement from tooth to tooth may absorb some over-travel. Over-travel may thus be reduced due to the possibility to advance the fast idle lever one more tooth. However, due to part variability, the advancement from tooth to tooth may not be smaller than the over-travel, and hence the choke valve can in such cases still be pulled off full choke for such over-travel, albeit a small amount.

Still another recent solution to the foregoing over-travel and resultant choke valve pull-back, slight re-opening problem is provided by the invention disclosed and claimed in co-pending Pattullo U.S. patent application Ser. No. 09/252,257 filed Feb. 18, 1999, now U.S. Pat. No. 6,202,989, also assigned to Walbro Corporation and incorporated herein in toto by reference. The Pattullo application invention utilizes a fast idle lever and throttle lever in the carburetor automatic fast idle control mechanism similar to those of the aforementioned '480 patent. However, in one preferred but exemplary embodiment disclosed in the Pattullo application, the choke shaft is made from a torsionally flexible material, such as Delrin® acetal plastic, that can be torsionally stressed to enable continued rotation of the choke shaft portion carrying the fast idle lever after the choke valve reaches full closure. Hence further pivotal motion of the fast idle lever past its choke closed position is produced before the fast idle lever reaches latch-up engagement with the throttle lever.

A novel spring biased, lost motion operating linkage for the choke valve and fast idle lever is thus achieved that prevents retrograde opening motion of the choke valve from its fully closed design position upon release of operator actuating force. This is achieved regardless of variations in the angular range of relative orientation of the fast idle lever free end with respect to the tang of the throttle lever throughout the range of tolerance stack-up positions of these parts, as well as the tolerance stack-up in the remaining operably cooperative mechanism parts when mass produced to the pre-existing tolerance specifications. The override capability of the choke shaft thus insures complete choke valve closure without concern for the required manufacturing tolerances.

Thus, the Pattullo application invention involving the aforementioned flexible choke shaft design achieves the goal of eliminating "over-travel", because the choke valve closes well in advance of the fast idle lever and throttle lever nesting in lock-up. However, to nest these two levers the operator must twist the choke shaft via the choke lever. If the operator does not twist the choke lever far enough, the two levers will not nest. Hence, the control linkage to operate the choke lever must insure that sufficient choke shaft twisting is achieved by the time the linkage reaches its setting for fast idle start.

Another limitation of this Pattullo system is that the choke shaft must be made of a flexible material, such as the plastic material specified in the Pattullo application, for this design to function properly. Moreover, because the choke shaft must twist, the choke lever must be located on the same side of the carburetor as the fast idle lever. That is, if the choke lever and fast idle lever are mounted on opposite sides of the carburetor, the choke shaft twisting action will not transmit all the way through the choke shaft due to the choke valve plate being inserted through the choke shaft and thereby rigidifying the same against twisting, i.e., the twisting stops at the choke valve plate. Thus, there is a need for further improvements in fast idle starting systems that will overcome these limitations of the Pattullo FISS structure and mode of operation as well as being applicable to carburetors with non-twistable choke shafts, and that will also overcome the aforementioned limitations of the Van Allen '683 patent improvements.

Another prior art structure added to many carburetor choke linkages are ball and spring detents that are operable to apply a force to help keep the choke valve closed. However, these detent systems add cost, and in any event are not easily used in conjunction with a FISS because they do not generate enough force to overcome the rock-back forces produced by the powerful throttle valve spring.

OBJECTS OF THE INVENTION

Accordingly, among the objects of the invention are to provide an improved carburetor choke and throttle mechanism providing automatic throttle fast idle setting capability that obtains the advantages of the Johansson U.S. Pat. No. 4,123,480 system as compared to the alternative system of the Hermle U.S. Pat. No. 5,200,118, while at the same time overcoming the aforementioned problems encountered in mass production of carburetors employing the '480 patent system so that when the parts are made to the existing entire range of dimensional tolerances the fast idle lever will nevertheless properly engage the throttle lever in such a manner that the choke valve plate will move to, and remain in, the fully closed position, thereby eliminating the poor starting or worse case, no starting, conditions described hereinabove.

Another object of the invention is to provide an improved carburetor choke and throttle automatic fast idle mechanism of the above character which solves the aforementioned problems by replacing a minimal number of parts with an improved fast idle lever that can be used in a conventional FISS configuration or with the improved torsionally resilient choke shaft and choke valve plate subassembly of the aforementioned Pattullo co-pending application, at less cost than that of the replaced parts, and one that can be substituted as a running change in production, that does not significantly alter the manufacturing and assembly processes already employed in the manufacture of the prior mechanism, which is readily retrofitable to existing carburetors as a field repair item if desired, and which does not require any tightening up of existing manufacturing tolerances and thus avoids the additional costs of attempting to achieve such improved precision in processing methods and machinery as well as assembly equipment and fixturing.

A further object of the invention is to provide an improved FISS mechanism of the above character which is readily adaptable for use with a choke shaft that is metal and thus torsionally rigid, as well as with a plastic choke shaft that is torsionally resilient and twistable in its mode of operation as in the aforementioned Pattullo application system, which provides the option of eliminating ball and spring detents that have been used to help the choke valve stay completely closed, and which is adaptable to so-called "split linkage" carburetors having the choke lever and fast idle levers disposed one on each of the opposite sides of the carburetor from each other, which insures that the throttle lever and fast idle lever are rendered operably independent from the choke lever in the fast idle starting condition with the choke closed to thereby eliminate the choke valve pull-back effect, which insures that the throttle valve fast idle position is held with more accuracy and which insures that manufacturing tolerance stack-up cannot adversely affect choke valve closure even with simple lever configurations, thereby allowing for complete closure of the choke valve when the fast idle lever is engaged while preventing interference with the choke lever from the movement or positioning of the fast idle lever when nestably locking up with the throttle lever in establishing the fast idle start condition.

Still another object is to provide an improved fast idle starting system of the aforementioned character that will insure complete and consistent closure of the choke valve on fast idle starting systems for diaphragm carburetors, which prevents the choke valve from floating and/or springing-back so as to prevent inconsistent closure of the choke valve from these effects, which is of lower cost and more forgiving to tolerance stack-up than current ball and spring detent systems, and which is better suited to the "flexible shaft" fast idle starting systems of the aforementioned Pattullo co-pending application.

SUMMARY OF THE INVENTION

In general, and by way of summary description and not by way of limitation, the invention fulfills the foregoing objects by merely substituting a novel fast idle lever for the corresponding prior art part, the remaining choke shaft, choke valve plate and throttle lever parts of the carburetor automatic fast idle control mechanism being retained and utilized without change, if desired.

In one preferred but exemplary embodiment utilizing the aforementioned Pattullo flexible shaft feature, the choke shaft is made from a torsionally flexible material, such as Delrin® acetal plastic, that can be torsionally stressed to enable continued rotation of the shaft portion carrying the fast idle lever after the choke valve reaches fall closure. This then produces further pivotal motion of the fast idle lever before it reaches latch-up engagement with the throttle lever.

Additionally or alternatively, the choke lever carries a resiliently flexible latch hook that is operable to resiliently pull the choke valve fully closed. This hook releases when the choke is moved by operator control from closed toward open position while the fast idle lever remains latched at engine start-up. The hook re-latches when the fast idle lever is released from lock-up with the throttle lever. Thus, an improved spring biased, lost motion operating linkage for the choke valve and fast idle lever is achieved in a simple, low-cost manner that prevents retrograde opening motion of the choke valve from its fully closed design position upon release of operator actuating force. This is achieved regardless of variations in the angular range of relative orientation of the fast idle lever free end with respect to the tang of the throttle lever i.e., throughout the range of tolerance stack-up positions of these parts, as well as that of the remaining operably cooperative mechanism parts when mass produced to the pre-existing tolerance specifications. The override capability of the choke shaft thus insures complete choke valve closure. without concern for the required manufacturing tolerances.

As a common and primary feature to both twistable and non-twistable choke shaft embodiments incorporating the invention, the distal free edge surface of the fast idle lever blade that is engaged by the tang of the throttle lever during fast idle latch-up is modified so that initially the tang exerts a resistive torque, and then just prior to such latch-up engagement a momentary additive torque is developed in the fast idle lever acting in the same rotational direction as the propelling torque applied by manual rotation of the choke lever. This camming interengagement accelerates fast idle lever rotation relative to choke lever rotation and thereby opens up a leading gap so that there no longer is push contact between the choke lever finger and fast idle lever tang. This additive torque is developed by a camming action of the throttle lever tang as its powerfill biasing spring causes the tang to slide down a camming ramp surface of the fast idle lever blade distal edge toward a lock-up "V-notch" therein. This "V-notch" is located by design so that when the throttle lever tang engages the same to latch and thereby hold the fast idle lever immobile, the leading gap, albeit smaller, is still present between the fast idle lever tang and the pusher finger of the choke lever. Hence, should counter-rotation of the fast idle lever occur, it is stopped by latch-up action before such counter-rotation can produce a push-back effect on the choke lever. Hence, spring-back or pullback re-opening the closed choke valve cannot occur.

BRIEF DESCRIPTION OF THE DRAWINGS

The foregoing as well as other objects, features and advantages of the present invention will become apparent from the following detailed description of the best mode, appended claims and accompanying drawings (which are to engineering design scale unless otherwise indicated) in which:

DETAILED DESCRIPTION OF THE PREFERRED EMBODIMENT OF THE INVENTION

First Embodiment

Referring in more detail to the accompanying drawings, FIGS. 1 through 8 illustrate the principal operative components of a first embodiment of the improved throttle-choke automatic fast idle throttle setting mechanism of the invention. The system of FIGS. 1–8 employs some of the same component parts and operates generally in the same, albeit improved, manner as the Johansson '480 patent construction described as prior art in conjunction with FIGS. 8–13 of the aforementioned Van Allen U.S. Pat. No. 6,000,683. Thus, the first embodiment automatic latch mechanism of the invention is well adapted for installation in and on a modern small engine carburetor 30 of conventional well-known construction. Accordingly, the structure, function and mode of operation of carburetor 30 will be understood by those skilled in the art from the views of FIGS. 1–8 and thus for brevity is not further described herein.

Figure 1:
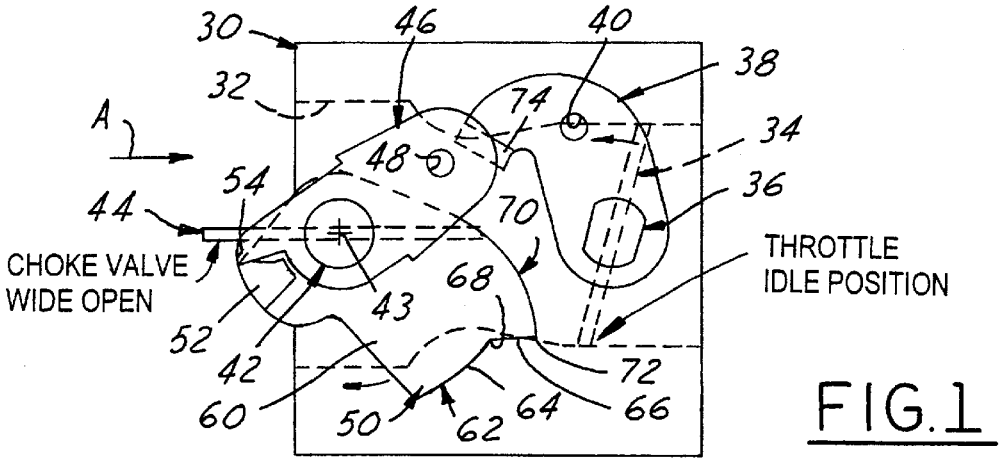
FIGS. 1–8 are simplified diagrammatic side elevational views of a first embodiment of a fast idle starting system constructed in accordance with the invention and sequentially illustrating the structure, function and mode of operation of the principal components in their respective position in eight operational stages of the system.

More particularly and referring to FIGS. 1–8, it will be seen that carburetor 30 is shown diagrammatically in side view with the direction of air-flow through the carburetor throat 32 indicated by the arrow labeled "A" in the view of FIG. 1 as well as in the remaining diagrammatic views 2–11. The fast idle starting system (FISS) components include a butterfly throttle valve 34 fixed on and rotatable with a rotatable throttle shaft 36. Throttle shaft 36 is biased by a relatively strong spring (not shown) coupled between shaft 36 and the carburetor body to bias shaft 36 in a counterclockwise direction as viewed in FIG. 1 and hence to bias throttle valve 34 toward its closed position as shown in FIG. 1. Throttle shaft 36 carries fixed thereon a throttle lever 38 to which a conventional throttle control linkage (not shown) is connected at hole 40 for bi-directionally swinging throttle lever 38 clockwise about the axis of shaft 36 between the throttle valve closed position of FIG. 1 to a throttle valve fully open position (not shown). The fast idle start system also includes the choke shaft 42 that carries (fixed thereon for rotation therewith) a butterfly choke valve 44, shown in wide open position in FIG. 1. Choke shaft 42 also carries fixed thereon a choke lever 46 to which swinging motion about the axis of shaft 42 is imparted by the conventional choke control linkage (not shown) coupled to choke lever 46 at its opening 48. The control linkage can be operated to swing, via choke lever 46, choke valve 44 from its wide open position of FIG. 1 to its fully closed position of FIG. 6. The conventional choke biasing spring is operably coupled between choke shaft 42 and the body of carburetor 30 to spring bias choke shaft 42 for rotation in a clockwise direction (as viewed in FIGS. 1–8), toward the choke valve wide open position of FIG. 1.

A fast idle lever 50 constructed in accordance with the present invention is freely journaled on choke shaft 42 for rotation about the axis thereof, and is lightly spring biased by a fast idle spring (not shown) coupled between fast idle lever 50 and choke shaft 42 to bias fast idle lever 50 in a clockwise direction as viewed in FIGS. 1–8 toward push-coupling with choke lever 46.

The fast idle lever 50 has a laterally protruding tang 52 that is pushed into abutment with a push finger 54 of choke lever 46 by the biasing force of the light biasing fast idle lever spring when the parts are in their operative position of the operational stages shown in FIGS. 1–4 and 8. As thus far described, it will be seen that the components of the first embodiment fast idle starting system are conventional.

It is to be understood that the small arrows employed in the views of FIGS. 1–8 indicate the torque applied to throttle lever 38 by the throttle biasing spring and the torque applied to fast idle lever 50 by the fast idle lever biasing spring, whereas the large arrows employed in these views indicate the torque applied to the choke lever by the choke control linkage and to the throttle lever by the throttle control linkage.

In accordance with a principal feature of both the first and second embodiments of the invention, the main blade 60 of fast idle lever 50 terminates in a specially contoured distal peripheral edge portion 62 (FIG. 1) that is made up of a convex ramp surface portion 64 and a camming surface portion 66 (preferably a straight line surface) that define at their juncture a "V-notch" 68 which functions as an abutment or latch stop. Blade 60 also has a convex leading edge camming surface portion 70 that intersects straight camming portion 66 at an acute angle apex 72.

Throttle lever 38 has the usual laterally protruding tang 74 that is constructed and arranged to be disposed in the rotary travel path of leading edge surface 70 as well as that of camming surface 66 and convex surface 64 of distal edge portion 62 of fast idle lever 50. Tang 74 has a right angle distal edge 76 extending perpendicular to the plane of the drawing to provide a locking edge adapted to nest with substantially line contact of tang 74 in the locking notch 68 of fast idle lever 50 in the lock-up condition of these parts shown in FIGS. 5–7.

Figure 2:
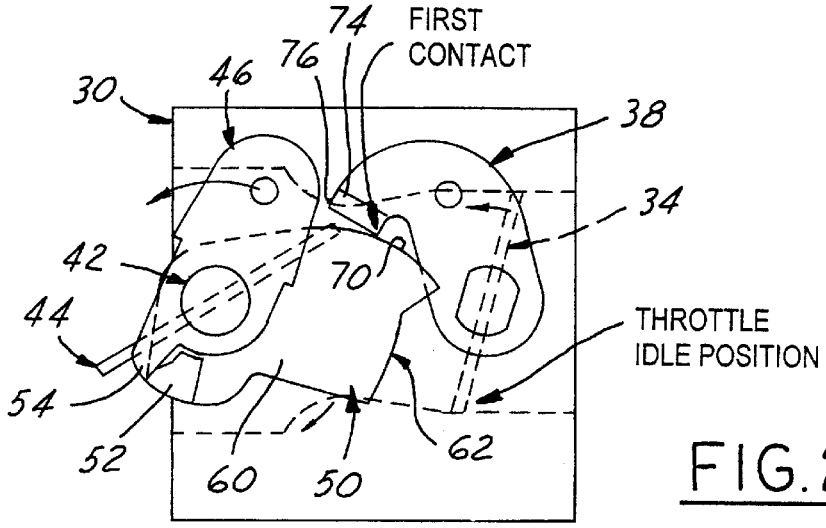
Figure 3:
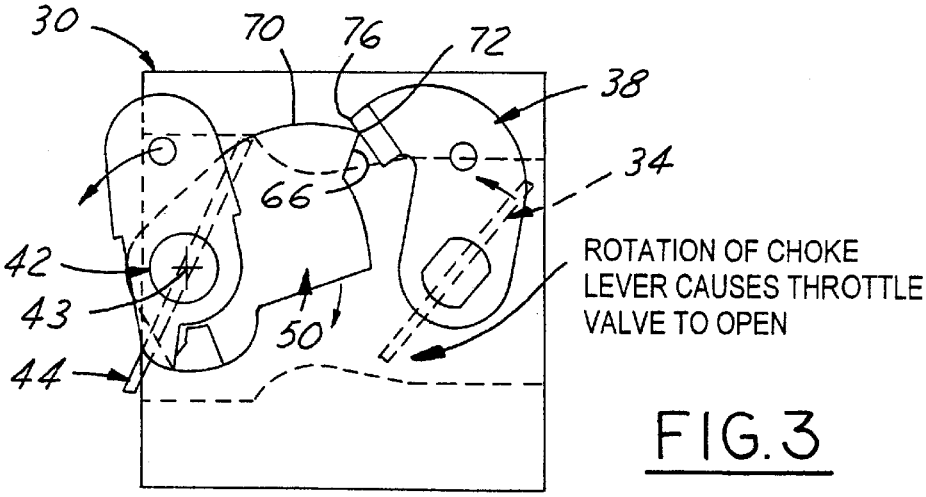
Figure 4:
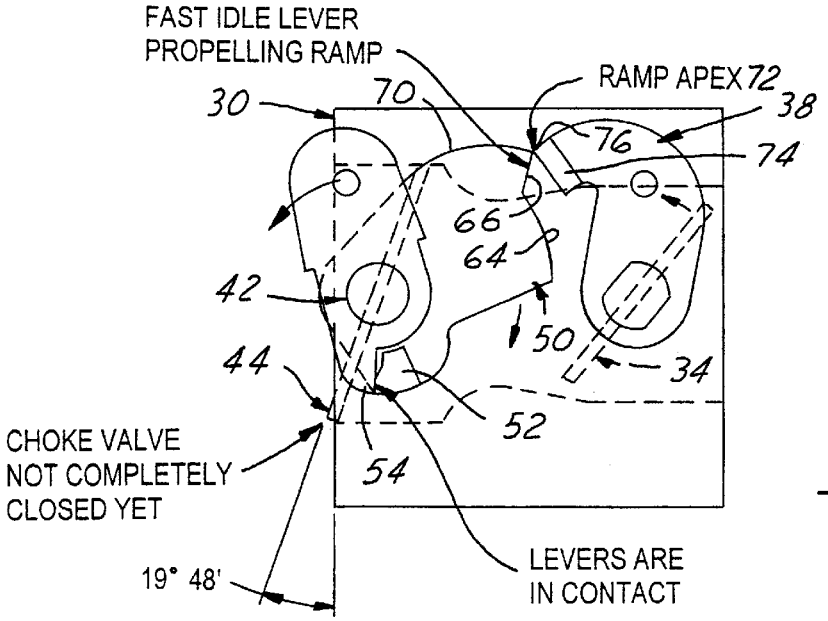

The operation of the first embodiment fast idle system of the invention will now be described in conjunction with the views of FIGS. 1–8. Referring to FIGS. 1 and 2, the operator rotates choke valve 44, via the operation of the choke linkage coupled to the choke lever 46, to thereby rotate the choke valve 44 from its wide open position of FIG. 1 toward the full closed choke position, a first increment of such movement being. shown in FIG. 2. During such rotation of choke lever 46, at approximately half-way of rotation from open, as will be seen in comparing FIG. 2 with FIG. 1, choke lever 46 has pushed the fast idle lever 50 via push-foot 54 abutting tang 52, to thereby rotate blade leading edge 70 into contact with throttle lever tang 74. Continued counterclockwise rotation of choke shaft 42 under choke control linkage force applied to choke lever 46 causes cam ramp edge 70 to slide beneath and thus raise tang 74 to thereby rotate throttle lever 38 clockwise from the position of FIG. 2 to that of FIG. 3. During this rotation, throttle valve 34 will rotate from its normal idle position in FIG. 2 to its partially open position shown in FIG. 3. Likewise, choke valve 44 will have been rotated clockwise further to the partially closed position on FIG. 3. However, before choke lever 46 has been swung to move choke valve 44 to the full choke position (FIG. 6), distal edge 76 of tang 74 of throttle lever 38 will reach the apex 72 of fast idle lever 50, as shown in FIG. 4. Notice in FIG. 4 that the choke valve angle is indicated at 19 degrees, 48 minutes, which is almost but not completely closed. Notice also the push abutment contact between choke lever push finger 54 and fast idle lever tang 52 is still being maintained, such push contact having produced up to this point the counterclockwise rotation of the fast idle lever 50 from its position shown in FIG. 1 to its position shown in FIG. 4. The light biasing contact between the choke lever and the fast idle lever is maintained up to this point by the light biasing force (as compared to the throttle return spring biasing force) of the fast idle lever biasing spring that is coupled to the carburetor body 30 for bodily rotation therewith.

Figure 5:
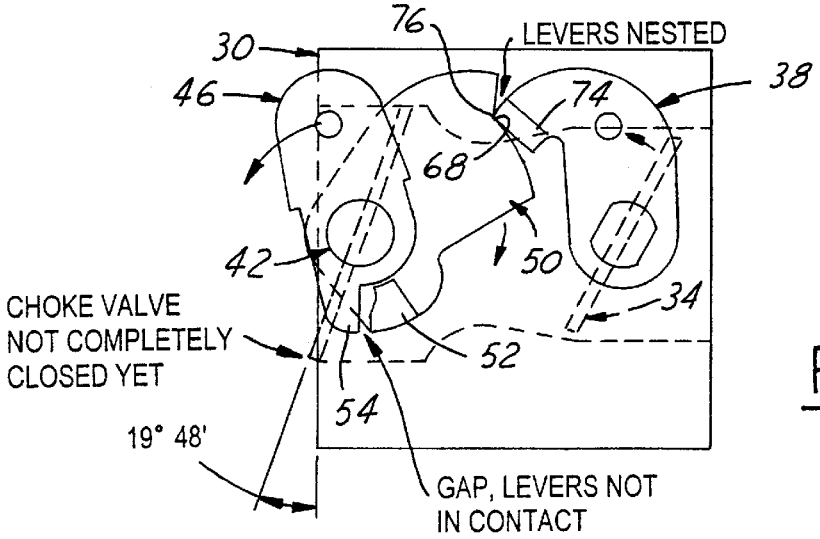

Once the distal edge 76 of throttle lever tang 74 has passed over apex 72 of the fast idle lever 50, the biasing force of the throttle lever return spring that is constantly developing a counterclockwise torque on lever 38 will thereupon force tang 74 down the fast idle lever cam ramp surface 66. Due to the specific inclination or angle of orientation of cam surface 66 relative to the axis 43 of choke shaft 42 at this point in the latch system motion, and the curved path of travel of tang leading edge 76, an additive, accelerating camming action is developed as edge 76 slides down camming surface 66. This resolves into counterclockwise torque on the fast idle lever 50, which is a reversal of the clockwise torque resistively exerted on fast idle lever 50 by tang 74 up to its reaching apex 72. Due to the strength of the throttle lever biasing spring being much greater than that of the fast idle lever biasing spring, this reversal in applied torque forces from throttle lever 38 causes tang 74 to be forced down cam ramp 66 to thereby accelerate rotation of fast idle lever 50 relative to choke lever 46. This in turn causes tang 52 to separate from push foot 54 to thereby open up a "leading" gap therebetween, as shown in FIG. 5, as tang edge 76 reaches nested and lock-up position in "V-notch" 68. Notice the choke valve angle in FIG. 5 and the momentary wide gap. This momentary speed up in the counterclockwise rotation of fast idle lever 50 as choke lever 46 is being counterclockwise rotated by the choke control linkage occurs as the parts shift from their condition shown in FIG. 4 to that of FIG. 5. At this point in the rotation of choke lever 46, fast idle lever 50 and throttle lever 38 become nested as shown in FIG. 5 and thus levers 50 and 38 are locked up in their pre-start position. Throttle valve 34 is now also held at the most beneficial angle for starting the engine, i.e., the fast idle start position shown in FIGS. 5, 6 and 7.

Figure 6:
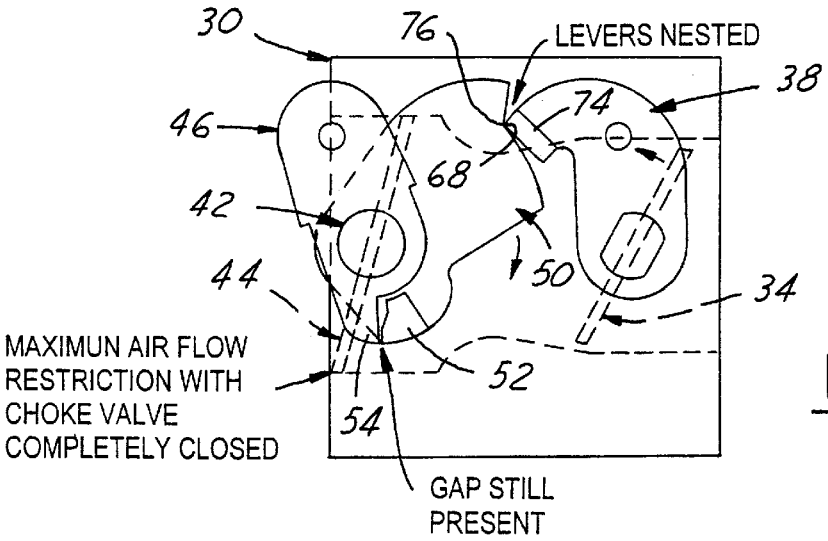

As shown in the sequence of FIGS. 5 to 6, the desired air-flow restriction essential for cold starting is attained once the choke valve, under the rotational force imparted by choke lever 46, completes its full angular rotation counterclockwise to the fill choke position shown in FIG. 6. Note in FIG. 6 that there is still a gap present between the choke lever pusher foot 54 and fast idle lever tang 52, even though this gap has been narrowed from that of the momentary wide open gap of FIG. 5. Hence fast idle tang 52 is not in a position to block slight counterclockwise rotation of choke lever 46 and hence, choke valve 44, much less to exert a push-back force therebetween. Note also that once the system condition of FIG. 6 has been established, choke valve 44 has been able to reach completely closed condition under the control of the choke control linkage. Note also that throttle lever 38 and fast idle lever 50 are still locked up in a stable orientation with tang leading edge 76 nested in notch 68 whereby the force of the throttle biasing spring and the force of the fast idle lever biasing spring are effective to maintain the parts latched in this nested relationship. Note further in FIG. 6 that throttle valve 34 is at the preferred slightly open angle (fast idle) for starting the engine.

The operator then releases manipulating force on choke lever 46. At this point fast idle lever 50 and throttle lever 38 are still nested as shown in FIG. 6. Throttle valve 34 is still in the pre-start position preferred for starting (fast idle). Choke valve 44, which was completely closed (full choke) as described in the transition from FIG. 5 to FIG. 6, has remained completely closed. By contrast, in a prior art conventional FISS, the choke valve would be subject to the pull-back effect as shown in the transition between FIGS. 9 and 10 of the aforementioned Van Allen U.S. Pat. No. 6,000,683 and explained in the description referencing these figures, as well as in FIGS. 12 and 13 thereof.

Intake combination air will be drawn into the engine via the carburetor throat. This in turn will draw fluid fuel out of the carburetor throat. Since the fast idle starting system of the first embodiment of the invention has positioned the choke and throttle valves in the most beneficial positions to allow the engine vacuum to optimally draw fluid from the carburetor into the engine for engine start-up, the engine will start and begin running under its own power. Because the engine is now running under its own power, it no longer needs the rich mixture of fuel that the carburetor produces when the choke valve is in the full choke position of FIG. 6. Therefore, the choke valve 44 can now be moved, by the operator manipulating the choke control linkage, to thereby move choke valve 44 from its fully closed position in FIG. 6 to its fully open position shown in FIG. 7. During this start-up sequence, throttle valve 34 has been held in the pre-start position of FIGS. 5, 6 and 7, because the throttle lever 38 and fast idle lever 50 are still latch locked due to tang 74 nesting in the "V-notch". Note also (FIG. 7) that the relative clockwise rotation of choke lever 46 relative to fast idle lever 50 has widely separated choke lever push foot 54 from the fast idle lever tang 52 to the maximum extent, while compressing the light biasing spring of the fast idle lever to its maximum operational extent.

Figure 7:
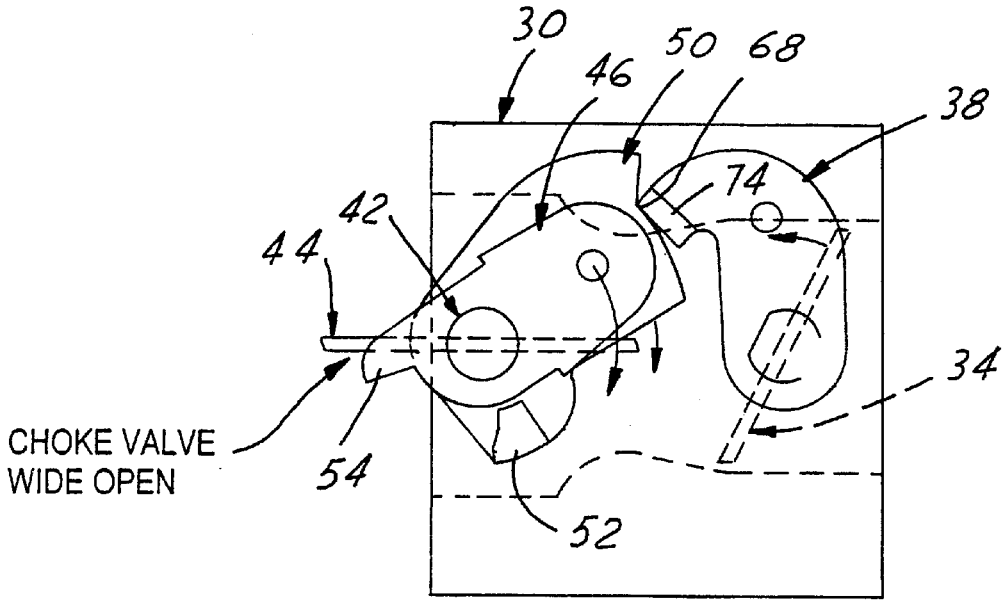
Figure 8:
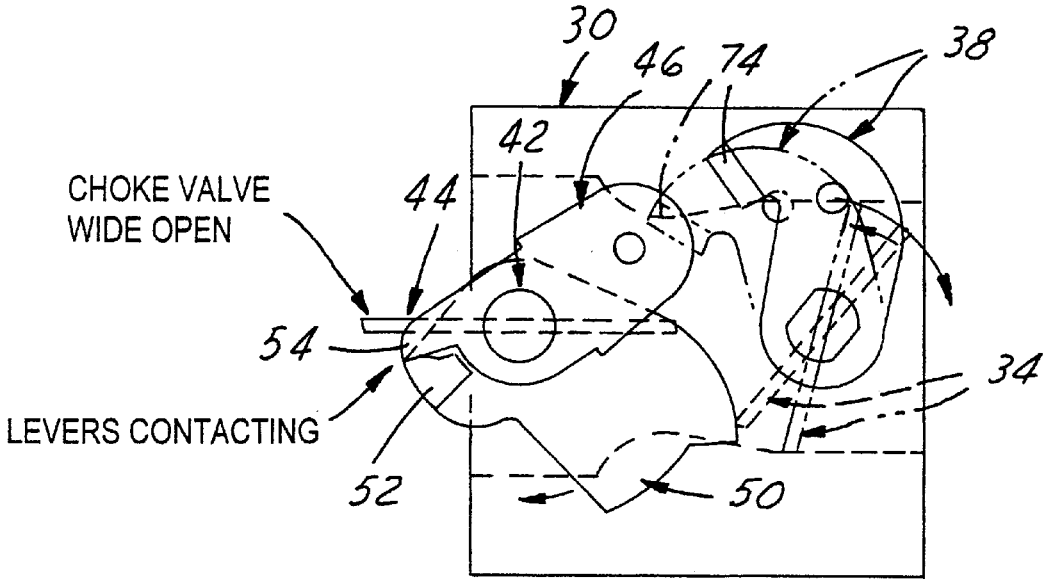

Through manipulation of the throttle control linkage, the operator now advances the throttle lever 38 from its fast idle start position of FIG. 7 toward wide open throttle (WOT) position (not shown). As shown in the sequence of part motion from FIG. 7 to FIG. 8, this rotates tang 74 upward out of engagement with fast idle edge 62. This releases fast idle lever 50 so that its biasing spring will return it, by clockwise rotation from the position of FIG. 7 to that of FIG. 8 until tang 52 comes into abutment with foot 54 to re-establish the push relationship that enables the action sequence of FIGS. 1–4. The engine starting sequence is now complete.

It will be seen that the revised configuration of the distal peripheral edge portion 62 of the fast idle lever 50, in accordance with the principal feature of the invention, has insured a consistent closure of choke valve 44 and therefore consistent high vacuum when choking a diaphragm carburetor. This in turn results in improved cold engine starting at essentially no added cost, but rather merely a running manufacturing change in producing part 50. The invention thus utilizes the throttle return spring force to force throttle lever 38 and fast idle lever 50 into a locked-up condition that by design and orientation, positions the tang 52 clear of abutment with pusher foot 54 of choke lever 46 when its rotation in a counterclockwise direction is stopped by choke valve 44 engaging the surface of the carburetor throat in the completely closed condition thereof (full choke). This positioning of the choke valve is therefore reliably accomplished by the operator pulling the fast idle knob completely to the predetermined fast idle position.

A conventional ball and spring detent can be added to the choke shaft to further bias the choke valve to the fully closed position, in accordance with conventional prior practice, if desired.

Figure 18:
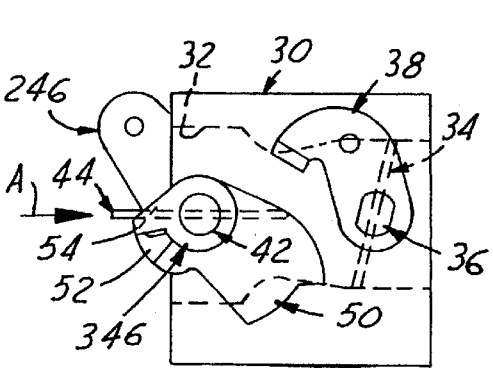
FIGS. 16, 17 and 18 are respectively a simplified diagrammatic port side (relative to air flow) view, an inlet end view and a starboard side view of a third embodiment "split linkage" carburetor equipped with a first embodiment type rigid choke shaft and choke lever.
Figure 17:
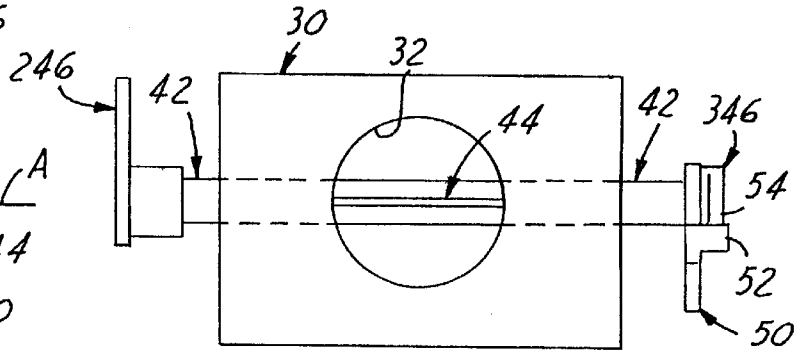
Figure 16:
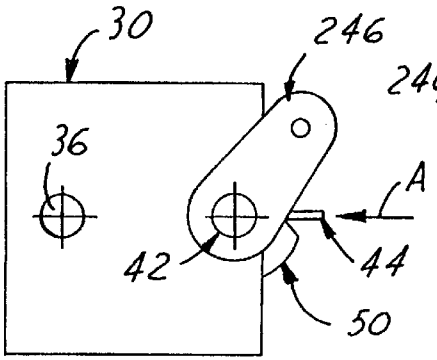

Advantageously, the first embodiment system can be installed readily on existing conventional carburetors utilizing prior fast idle systems, whether utilizing a metal choke shaft or a plastic choke shaft, as disclosed in the aforementioned Pattullo co-pending application. The first embodiment system also enables choke lever 46 to be installed on one side of the carburetor and the fast idle lever 50 installed on the opposite side of the carburetor, as is the practice in some "split linkage" designs of small diaphragm carburetor constructions. (This variation is illustrated in FIGS. 16, 17 and 18 referenced hereinafter). Elimination of the rock-back effect, due to the cam action of tang 76 sliding down along cam ramp 66 and thereby disabling pushcoupling between the fast idle lever and the choke lever, eliminates the need to provide the predetermined manufacturing tolerance gap E described in conjunction with the Van Allen U.S. Pat. No. 6,000,683 and identified as the tolerance gap E shown in FIGS. 9 and 12 thereof as hitherto required to insure latch-up and locking of the fast idle starting system and systems prior to the Van Allen invention approach.

The first embodiment fast idle lever 50 as designed for one working embodiment is shown to engineering scale in the views of FIGS. 12, 13, 14 and 15, the configurations, angles and dimensions set forth therein being incorporated herein by reference to these views, the same being representative of the best mode of making and using the first embodiment of the invention presently known to the inventors herein. However, it will be evident to those of ordinary skill in the art with the benefit of the foregoing description and drawings that contour variations may be readily made in the peripheral distal edge 62 of blade 60 and/or cam ramp 66 of fast idle lever 50 to suit the requirements of any particular FISS application, while retaining the novel mode of operation described hereinabove. Also, it is preferred that the fast idle lever 50 is constructed with a suitable material which has a low coefficient of friction such as acetal plastic (Delrin®).

Figure 13:
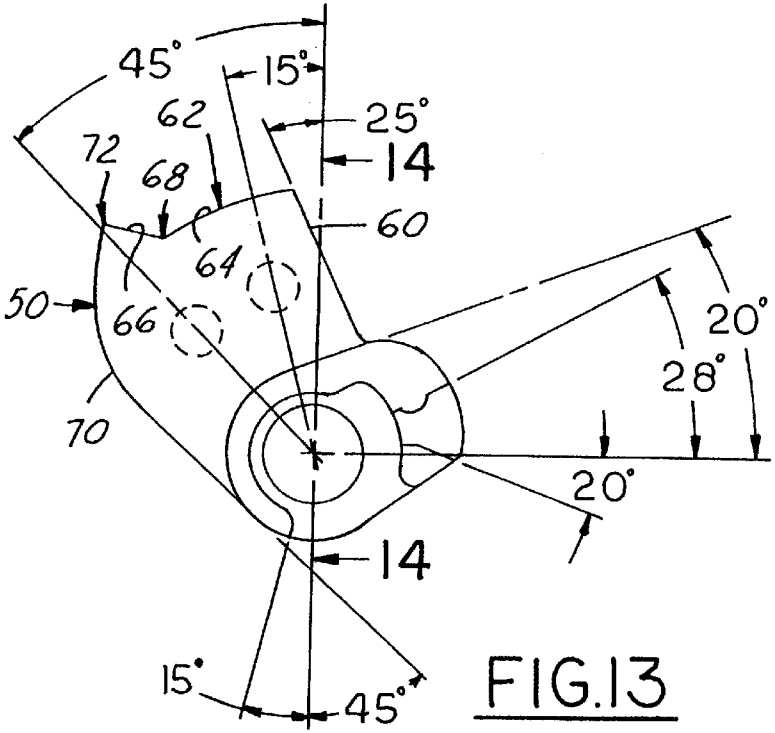
FIGS. 12 and 13 are respectively left-hand end and side elevational views of the improved fast idle lever part employed in both the first and second embodiment systems.
Figure 15:
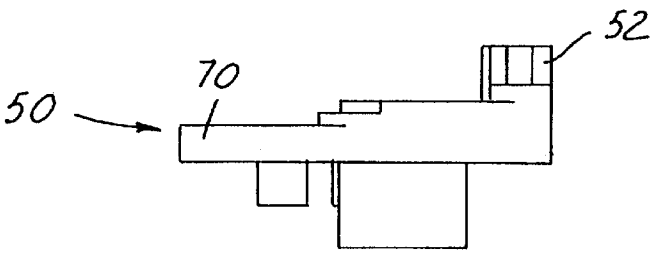
FIG. 15 is a bottom plan view of the fast idle lever part shown in FIG. 13.
Figure 12:
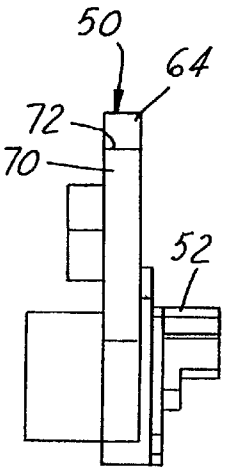

Although the mode of operation of the foregoing configuration of the distal peripheral edge surface 62 of fast idle blade 60, as illustrated and described by way of preferred example in conjunction with FIGS. 1 and 13, results in a gap-producing "acceleration" motion in blade 50 due to additive counterclockwise torque being cam-generated upon torque reversal, an alternative analysis may be helpful in understanding such mode of operation. During push coupling of foot 54 with tang 52 as choke lever 46 swings choke valve 44 toward closed position, the angular orientation of choke lever 46 relative to fast idle lever 50 may be considered to be zero degrees. After choke valve 44 has reached fully closed position, further counterclockwise rotation of choke lever 46 is prevented by choke valve 44 engaging the surface of carburetor throat 32. However, fast idle lever 50 is still free to thereafter continue counterclockwise rotation (since it is freely journalled on choke shaft 42), albeit against the resistive force of the light bias of the fast idle lever spring and the resistance of throttle lever tang as biased counterclockwise by the strong throttle return spring.

Therefore, the configuration of fast idle blade edge 62 relative to the travel path of tang edge 76 need essentially accomplish only two operational results, i.e., (1) notch lock-up to establish the spring-held-latched, fast-idle start position of throttle valve 34 shown in FIG. 6, and (2) create and maintain a gap-producing relative angular phase shift between choke lever foot 54 and fast idle lever tang 52, and this being designed to occur at least after choke valve fill closure and before (or at) such latched lock-up, regardless of whether any acceleration effect occurs as a by-product of such blade edge cam profile.

Second Embodiment

Figure 9:
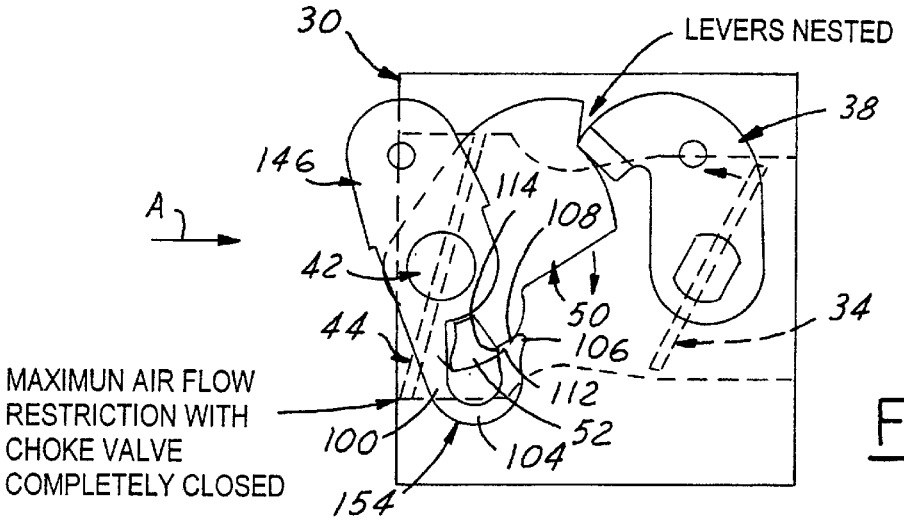
FIGS. 9–11 are simplified diagrammatic side elevational views of a resilient latch hook second embodiment of a fast idle starting system of the invention illustrating the relative position of the principal component parts in three operational stages of this second embodiment system.
Figure 10:
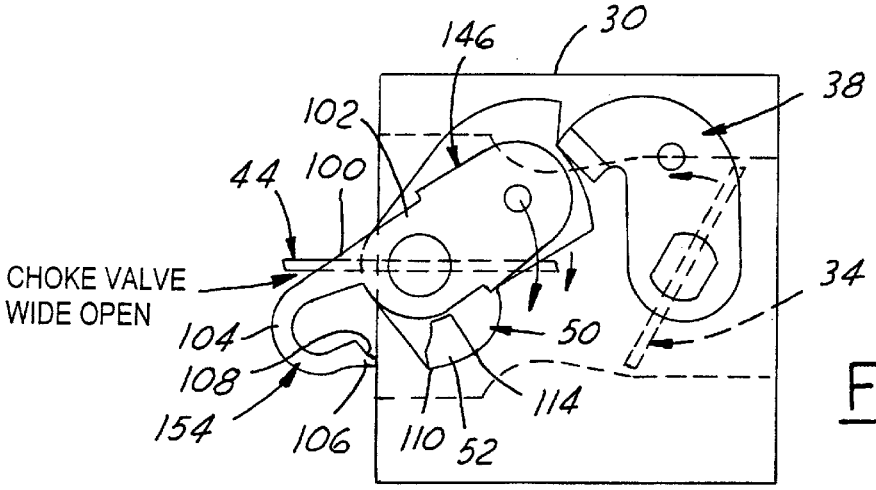
Figure 11:
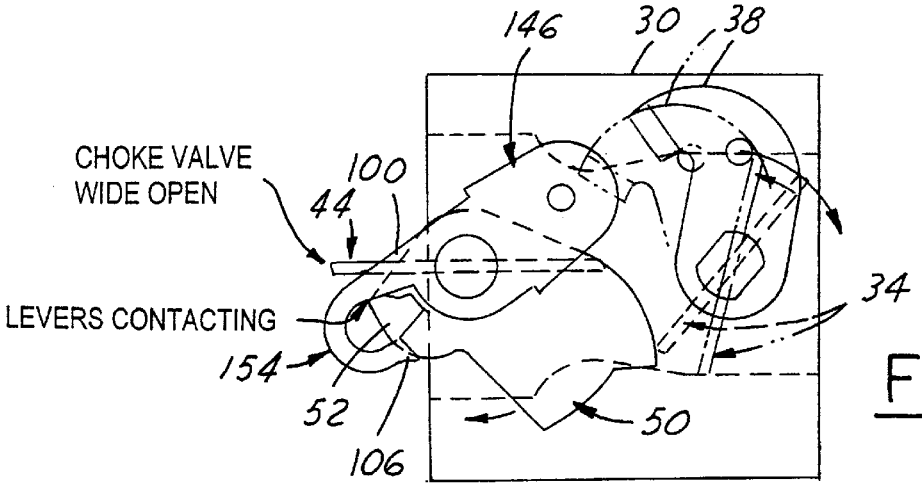
Figure 14:
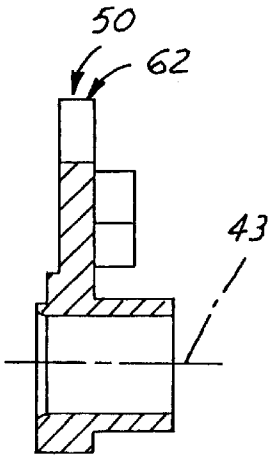
FIG. 14 is a cross-sectional view taken on the line 14—14 of FIG. 13.

The second embodiment of the invention as illustrated in FIGS. 9, 10 and 11, wherein the only change in component parts is that of the modified choke lever denoted 146 in these views. Choke lever 146 is constructed and mounted on choke shaft 42 in the same manner as choke lever 46 except for the modification of the pusher end of the choke lever. The pusher foot 54 of lever 46 is replaced by a flexible engagement hook portion 154 that is operable when the parts have been conditioned to the fast idle start position of FIG. 9 to pull and hold the choke valve closed when in its latched-up condition shown in FIG. 9. Preferably the choke lever hook 154 is molded as an integral portion of the choke lever 146 when the same is preferably made out of the material specified in the aforementioned co-pending Pattullo application, namely a resilient and flexible plastic material such as Delrin® acetal plastic. This is the material of the choke shaft disclosed in this co-pending application to provide a torsionally flexible material in the choke shaft. Hook portion 154 can be inexpensively manufactured and obtained as a running change in only one FISS part at little or no added cost.

It will be seen that the hook portion 154 has a pusher leg portion 100 that is widest at its integral junction with a body portion 102 of lever 146. Leg portion 100 narrows down (in the plane of the drawing) to a U-shaped spring-like portion 104 of generally constant width dimension that terminates in an elephant toe-shape foot portion 106. Foot 106 has a flat tread 108 that is angled so as to readily cam slide over the edge 110 of tang 52 closest to leg 100 when the lever 146 and lever 50 are rotated from their relative unlatched positions shown in FIG. 10 to their latched-up condition shown in FIG. 9. As will be seen in FIG. 9, the heal 112 of foot 106 latches over the distal edge 114 of tang 52 to provide the latched-up engagement of hook portion 154 to thereby releasably couple lever 146 to lever 50.

The resilience of the U-shaped portion 104 of hook 154 provides some "give" to accommodate part tolerance variations and assembly variations, while enabling the hook to be flexible enough to allow easy disengagement when opening the choke, i.e., when moving the choke lever 146 from the position shown in FIG. 9 to that of FIG. 10 as sufficient force is applied to pull foot 106 out of engagement with tang 52.

It will be seen that hook 154 is operable in moving from the FIG. 11 to the FIG. 9 condition to thereby establish reliable and consistent and fast idle starting conditions because hook 154 exerts a pulling force as it flexes to thereby provide a closing biasing force on choke valve 44. The tension stress in portion 104 of the hook 154 is obtained by the force indirectly provided by the throttle return spring acting through the torque reversal and cam lock-up action obtained between throttle lever 38 and fast idle lever 50, as described in connection with the first embodiment.

The flexible coupling hook 154 of the second embodiment is lower in cost and more forgiving to tolerance stack-up than current prior art ball and spring detent systems customarily used to bias the choke valve to fully closed position. The spring hook also solves the incomplete closure problem by utilizing the force generated by the throttle return spring transmitted through the fast idle lever via the improved "ramp" method of the first embodiment to thereby gently pull choke valve 44 closed. It will also be noted that the hook system of the second embodiment is well suited to the "flexible shaft" fast idle systems of the aforementioned co-pending Pattullo application. The potential problems of choke floating in and out of fully closed position and/or spring-back from prior FISS systems that result in inconsistent closure of the choke valve are therefore well solved by the second embodiment of the invention, and at little or no cost.

Third Embodiment

As indicated previously, FIGS. 16, 17 and 18 are simplified diagrammatic views of a third embodiment "split linkage" carburetor equipped with a first embodiment type rigid choke shaft 42 and rigid choke lever split up into two separate components comprising a crank arm part 246 and a pusher foot part 346. The crank arm 246 is fixed to one end of choke shaft 42 on one side of the carburetor, whereas the pusher part 346 is fixed to the axially opposite end of choke shaft 42 on the other side of the carburetor. The remaining components of the FISS third embodiment system are the same as in the first embodiment system, and it will be seen that the mode of operation is also the same in both embodiments.

Fourth Embodiment

Figure 21:
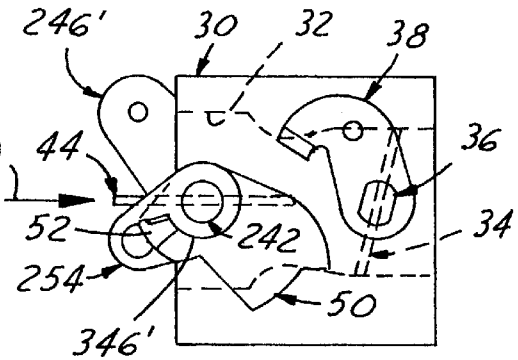
FIGS. 19, 20 and 21 are respectively a simplified diagrammatic port side view, an inlet end view and a starboard side view of a fourth embodiment "split linkage" carburetor equipped with a second embodiment type flexible choke shaft and resilient hook for releasably coupling the choke shaft to the fast idle lever.
Figure 20:
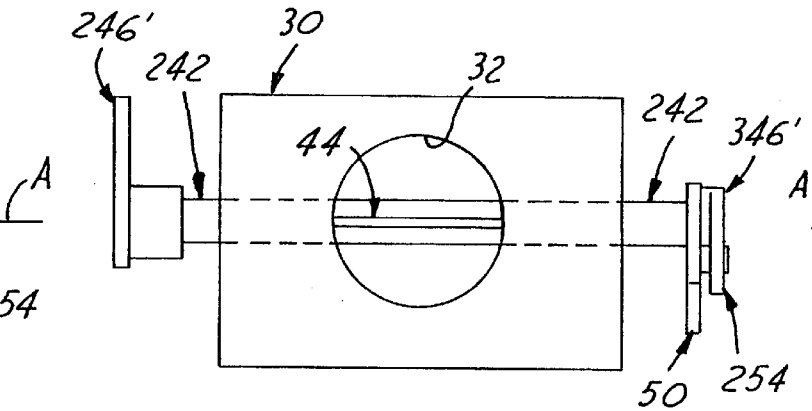
Figure 19:
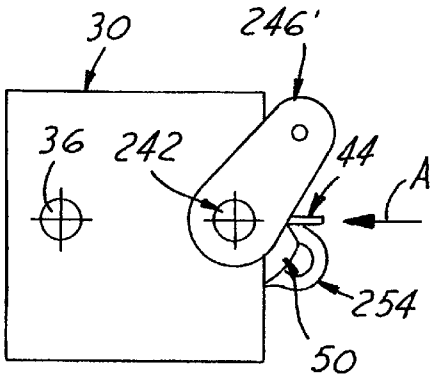

As also indicated previously, FIGS. 19, 20 and 21 are simplified diagrammatic views of a fourth embodiment "split linkage" carburetor equipped with a second embodiment type flexible choke shaft 242 and also a two-part choke lever made up of a choke arm 246' mounted on one axially extreme end of choke shaft 242 on one side of the carburetor. An associated choke lever pusher foot and hook part 254 is mounted on the other axially opposite end of choke shaft 242. These components thus function in the manner and in the mode of operation of the second embodiment system of FIGS. 9–11, and will provide reliable consistent full closure of the choke valve even though the flexible choke shaft 242 is rigidified by the insertion of valve plate 44 therethrough.

What is claimed is:

1. In a carburetor throttle and choke control mechanism incorporating a choke-throttle cold-start setting latch mechanism that automatically positions a throttle valve slightly open at a fast idle position when the choke valve is swung from open to fully closed position, and comprising a rotatable choke shaft carrying a choke plate valve, a rotatable throttle shaft carrying a throttle plate valve, a choke lever fixed on said choke shaft for rotating said choke valve from open to closed, a throttle lever fixed on said throttle shaft for rotating said throttle valve from idle to open against the bias of a throttle return spring, and a fast idle latch lever journaled on said choke shaft biased by a fast idle return spring, which in turn biases said choke valve (via said choke lever and choke shaft) from fully open to fully closed and having a free end swingable in a travel path generally co-planar with and intersecting the travel path of a free end of said throttle lever, a releasable latch on said free ends interengageable as a toggle that is held latched by said return springs in the choke-closed position of said choke valve and the fast idle position of said throttle valve, and wherein one of said choke and fast idle levers has a tang operable to push couple via said tang the other one of said choke and throttle levers such that choke closing rotation of said choke lever imparts co-rotation of said fast idle lever toward latched condition, the improvement in combination therewith wherein said releasable latch is constructed and arranged such that during said interengagement aiding torque is created to thereby angularly phase shift said fast idle lever relative to said choke lever and thereby open a gap in said push coupling at least after further rotation of said choke valve has been blocked by it reaching full closed position and that remains as a gap in the latched position of said valves.

2. The combination of claim 1 wherein at least one of said choke shaft and said choke plate valve is resilient to enable lost-motion, spring-biased override of said latch free ends to insure that the same are engageable when said choke plate valve is being held fully closed.

3. The combination of claim 2 wherein said at least one of said choke shaft and said choke plate comprises a torsionally resilient section of said choke shaft located between said choke valve and said choke lever.

4. The combination of claim 3 wherein said releasable latch comprises a ratchet notch provided on said free end of said fast idle lever, and a pawl provided on said free end of said throttle lever.

5. The combination of claim 4 wherein said torsionally resilient section of said choke shaft can accommodate an angular range of resilient twisting at least equal in angular pivot travel to the opposite end limits of angular pivot swing tolerances of said fast idle lever when within a given angular range of pivotal positions corresponding to said choke valve reaching its fully closed cold start position.

6. The combination of claim 3 wherein said choke shaft is molded of semi-resilient plastic material and protrudes at one end axially exteriorly of the carburetor, said choke lever being fixed on said one end of said choke shaft, said choke having a portion disposed interiorly of the carburetor and extending across a main air/fuel mixture venturi bore of the carburetor in which said choke and throttle valves are operably disposed, said choke plate valve being inserted through said slot to thereby mount said choke plate valve on said choke shaft.

7. The combination of claim 6 wherein said choke shaft and choke lever are integrally molded as a one piece unit.

8. The combination of claim 7 wherein said choke shaft is torsionally resilient and said choke valve plate is torsionally rigid.

9. The combination of claim 1 wherein said releasable latch comprises a ratchet notch provided on said free end of said fast idle lever and a pawl provided on said free end of said throttle lever, said fast idle lever having a blade with a peripheral edge contoured to define said ratchet notch and wherein said pawl is a tang on said throttle lever operable to slidably ride on said peripheral edge of said blade, said blade peripheral edge including a convex leading edge surface adapted to slidably engage said pawl tang during rotation of said blade between choke wide open and choke partially closed positions, said blade peripheral edge also having a camming ramp surface extending between a junction with said convex leading edge surface and the vertex of said notch to thereby define one flanking side of said notch, said blade peripheral edge having a convex surface extending from said notch vertex and oppositely inclined relative to said camming ramp surface to thereby define the other flanking side of said notch, said first convex surface and said camming ramp surface being oriented and contoured to be operable such that upon interengagement of said throttle pawl tang with said first surface said throttle lever yieldably resists rotation of said fast idle lever toward latch condition, and such that when said pawl tang rides over the intersection of said convex leading edge surface with said ramp surface said force reversal takes place, with said force exerted via said tang sliding on said ramp surface producing the said aiding torque to thereby accelerate said fast idle lever relative to said choke lever to thereby open said gap in said push coupling that remains in the latched position of said valves.

10. The combination of claim 9 wherein said push tang is provided on said fast idle lever as a lateral offset from the plane of rotation thereof, and said choke lever has a pusher foot adapted to abut in push relation said tang to produce said co-rotation thereof in response to rotational force imparted to said choke lever in rotating said choke valve from wide open toward closed condition.

11. The combination set forth in claim 10 wherein said pusher foot of said choke lever comprises a relatively rigid pusher leg portion adapted for abutment in push relation with said fast idle lever tang and an extension of said leg portion in the form of a generally U-shaped resilient spring hook portion adapted to overlap said tang and releasably hook engage the same when said leg portion is brought into full push abutment with said tang, said U-shaped hook portion being resiliently flexible to act as a spring to develop a torque on said choke by pulling said choke valve fully closed when said fast idle lever is moved to fully latched condition while flexing so that said gap remains between said pusher leg portion and said tang.

12. The combination set forth in claim 11 wherein said U-shaped resilient spring portion of said choke lever pusher terminates in the free end having an angled camming surface to facilitate sliding on an associated edge of said tang as said foot approaches a hook-over capture of said tang as said leg portion is brought into abutment with said tang.

13. The combination of claim 12 wherein said choke lever is made up of two parts, a choke lever arm fixed to said choke shaft on one side of said carburetor and a choke lever pusher foot part fixed to said choke shaft at the axially opposite end of said choke shaft on the opposite side of said carburetor and adjacent said fast idle lever, with both of said parts being fixed to said choke shaft for co-rotation therewith about the axis of said choke shaft.

14. The combination of claim 1 wherein said tang is disposed on said fast idle lever, and said choke lever has a pusher foot part comprising a relatively rigid pusher leg portion adapted for abutment in push relation with said fast idle lever tang and an extension of said leg portion in the form of a generally U-shaped resilient spring hook portion adapted to overlap said tang and releasably hook engage the same when said leg portion is brought into full push abutment with said tang, said U-shaped hook portion being resiliently flexible to act as a spring to develop a torque on said choke by pulling said choke valve fully closed when said fast idle lever is moved to fully latched condition while flexing so that said gap remains between said pusher leg portion and said tang.

15. In a carburetor throttle and choke control mechanism incorporating a choke-throttle cold-start setting latch mechanism that automatically positions a throttle valve slightly open at a fast idle position when the choke valve is swung from open to fully closed position, and comprising a rotatable choke shaft carrying a choke plate valve, a rotatable throttle shaft carrying a throttle plate valve, a choke lever fixed on said choke shaft for rotating said choke valve from open to closed, a throttle lever fixed on said throttle shaft for rotating said throttle valve from closed to open against the bias of a throttle return spring, and a fast idle latch lever journaled on said choke shaft biased by a fast idle return spring, which in turn biases said choke valve (via said choke lever and choke shaft) from fully open to fully closed and having a free end swingable in a travel path generally co-planar with and intersecting the travel path of a free end of said throttle lever, a releasable latch on said free ends interengageable as a toggle that is held latched by said return springs in the choke-closed position of said choke valve and the fast idle position of said throttle valve, and wherein one of said choke and fast idle levers has a tang operable to push couple via said tang the other one of said choke and throttle levers such that choke closing rotation of said choke lever imparts co-rotation of said fast idle lever toward latched condition, the improvement in combination therewith wherein said push tang is provided on said fast idle lever as a lateral offset from the plane of rotation thereof, and said choke lever has a pusher foot adapted to abut in push relation said tang to produce said co-rotation thereof in response to rotational force imparted to said choke lever in rotating said choke valve from wide open toward closed condition, and wherein said pusher foot of said choke lever comprises a relatively rigid pusher leg portion adapted for abutment in push relation with said fast idle lever tang and an extension of said leg portion in the form of a generally U-shaped resilient spring hook portion adapted to overlap said tang and releasably hook engage the same when said leg portion is brought into full push abutment with said tang, said U-shaped hook portion being resiliently flexible to act as a spring to develop a torque on said choke by pulling said choke valve fully closed when said fast idle lever is moved to fully latched condition while flexing so that said gap remains between said pusher leg portion and said tang.

16. The combination of claim 15 wherein said U-shaped resilient spring portion of said choke lever pusher foot hook portion terminates in the free end having an angled camming surface to facilitate sliding on an associated edge of said tang as said foot approaches a hook-over capture of said tang as said leg portion is brought into abutment with said tang.

17. The combination of claim 16 wherein said choke lever is made up of two parts, a choke lever arm part fixed to said choke shaft on one side of said carburetor and a choke lever pusher foot part fixed to said choke shaft at the axially opposite end of said choke shaft on the opposite side of said carburetor and adjacent said fast idle lever, with both of said parts being fixed to said choke shaft for co-rotation therewith about the axis of said choke shaft.

18. In a carburetor throttle and choke control mechanism incorporating a choke-throttle cold-start setting latch mechanism that automatically positions a throttle valve slightly open at a fast idle position when the choke valve is swung from open to fully closed position, and comprising a rotatable choke shaft carrying a choke plate valve, a rotatable throttle shaft carrying a throttle plate valve, a choke lever fixed on said choke shaft for rotating said choke valve from open to closed, a throttle lever fixed on said throttle shaft for rotating said throttle valve from closed to open against the bias of a throttle return spring, and a fast idle latch lever journalled on said choke shaft biased by a fast idle return spring, which in turn biases said choke valve (via said choke lever and choke shaft) from fully open to fully closed and having a free end swingable in a travel path generally co-planar with and intersecting the travel path of a free end of said throttle lever, a releasable latch on said free ends interengageable as a toggle that is held latched by said return springs in the choke-closed position of said choke valve and the fast idle position of said throttle valve, and wherein one of said choke and fast idle levers has a tang operable to push couple via said tang the other one of said choke and throttle levers such that choke closing rotation of said choke lever imparts co-rotation of said fast idle lever toward latched condition, the improvement in combination therewith wherein said releasable latch is constructed and arranged such that during said interengagement aiding torque is created to thereby angularly phase shift said fast idle lever relative to said choke lever and thereby open a gap in said push coupling and thereafter maintain such a push de-coupling gap that remains in the latched position of said valves.

19. The combination of claim 18 wherein said releasable latch comprises a ratchet notch provided on said free end of said fast idle lever, and a pawl provided on said free end of said throttle lever.

20. The combination of claim 19 wherein at least one of said choke shaft and said choke plate valve is resilient to enable lost-motion, spring-biased override of said latch free ends to insure that the same are engageable when said choke plate valve is being held fully closed.

21. The combination of claim 20 wherein said at least one of said choke shaft and said choke plate comprises a torsionally resilient section of said choke shaft located between said choke valve and said choke lever.

* * * * *